United States Patent [19]

Smith et al.

[11] 4,036,478

[45] July 19, 1977

[54] LIQUID QUENCHING SYSTEM

[75] Inventors: Jonathan Smith, Glen Ellyn, Ill.; Robert C. Larko; Eugene E. Booth, both of Meadville, Pa.

[73] Assignee: Sunbeam Equipment Corporation, Meadville, Pa.

[21] Appl. No.: 642,875

[22] Filed: Dec. 22, 1975

Related U.S. Application Data

[63] Continuation of Ser. No. 488,548, July 15, 1974, abandoned.

[51] Int. Cl.[2] ..... C21D 9/62

[52] U.S. Cl. ..... 266/133; 148/157

[58] Field of Search ..... 148/157; 134/61, 65–67, 134/132; 266/120, 130, 131, 133, 255, 259

[56] References Cited

U.S. PATENT DOCUMENTS

| | | | |
|---|---|---|---|
| 2,273,528 | 2/1942 | Karp | 134/132 X |
| 2,494,361 | 1/1950 | Scarbrough et al. | 266/133 |
| 3,340,109 | 9/1967 | Keough | 266/133 X |
| 3,616,807 | 11/1971 | Collins et al. | 266/130 X |
| 3,664,354 | 5/1972 | Minbiole, Jr. et al. | 134/132 X |
| 3,888,471 | 6/1975 | Coch | 266/120 |

FOREIGN PATENT DOCUMENTS

| | | | |
|---|---|---|---|
| 939,453 | 10/1963 | United Kingdom | 266/133 |

*Primary Examiner*—Roy Lake
*Assistant Examiner*—Paul A. Bell
*Attorney, Agent, or Firm*—George R. Clark; Neil M. Rose; John S. Pacocha

[57] ABSTRACT

A liquid quenching system for use with continuous furnaces for heat treating small parts wherein the quenchant is used to both quench and convey the parts. A supply conduit connects a quench liquid reservoir to a connector between the furnace and a quench chute providing an initial quantity of quench liquid in the quench chute. A feed conduit pumps additional quench liquid into the chute to convey the parts while they are being quenched to a segregating device comprising an inclined, rotating drum having an internal auger flight. The drum permits the return of clean quench liquid to the reservoir and moves the quenched parts substantially dry of quench fluid to a suitable receptacle or further conveying means. A portion of the quench chute forms a trunnion for rotatable support of the receiving end of the drum, the discharge end having a shaft mounted for rotation on the reservoir.

7 Claims, 7 Drawing Figures

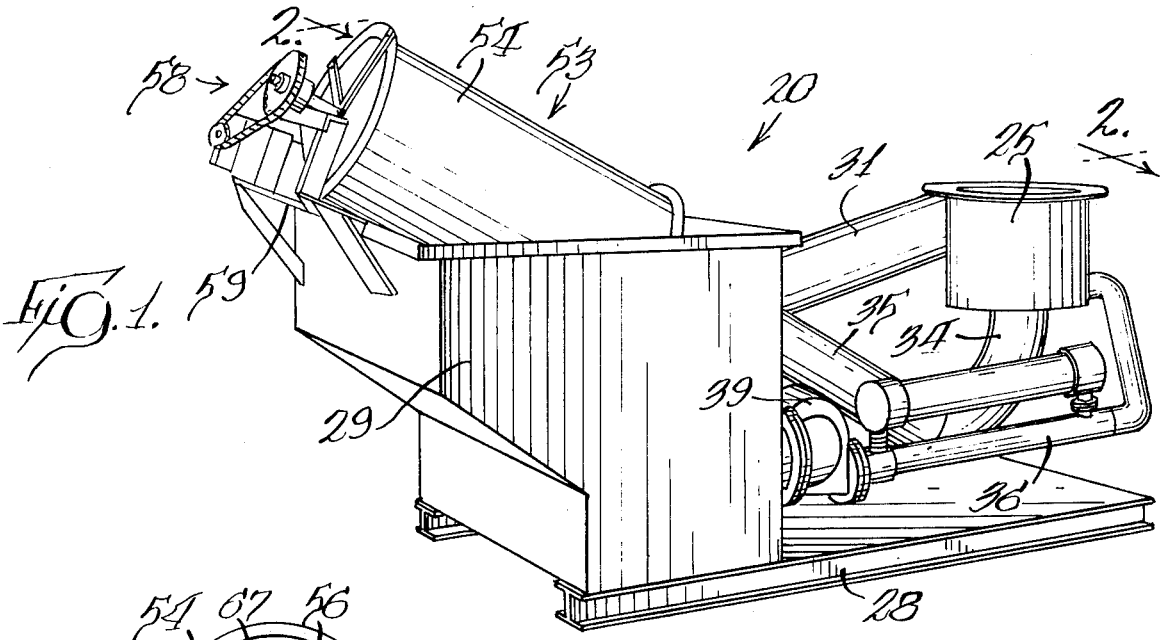
Fig. 1.
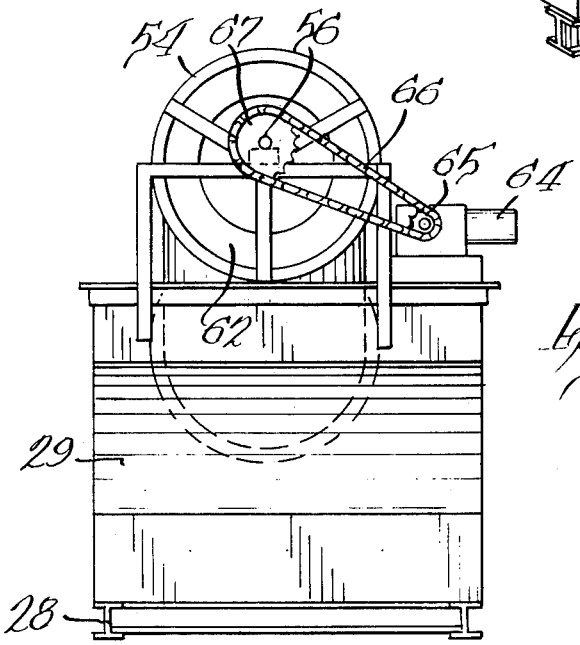
Fig. 3.
Fig. 4.
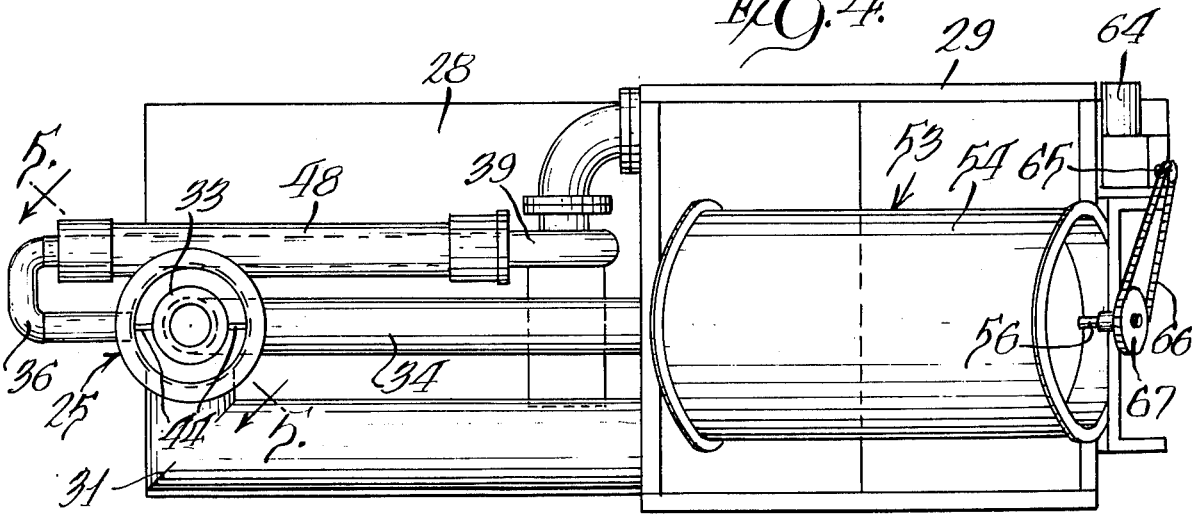

LIQUID QUENCHING SYSTEM

This is a continuation, of application Ser. No. 488,548, filed July 15, 1974 now abandoned.

BACKGROUND OF THE INVENTION

Continuous heat treat furnaces such as conveyor belt, shaker hearth or shuffle hearth furnaces are often used to heat treat large quantities of relatively small pieces of work such as screws, nuts, washers, bolts and pins. The handling of such small parts particularly during the quenching process has long presented problems in two major areas, one involving the metallurgical requirements for a thorough quench of each and every small piece and the other the practical economic requirements for recovery of the quenched pieces. Installation and maintenance of the quenching apparatus itself as well as the need to minimize both the initial quantity of quench liquid required and the loss of quench liquid during also present serious problems.

It has long been the practice in the prior art to include pit type quench systems such as those shown in the U.S. Pat. to Krach et al, Nos. 3,531,096, and Keough 3,650,853 for use in connection with furnaces of the conveyor belt, shaker hearth and shuffle hearth varieties. While the disadvantages of such pit type quench systems have been appreciated, to date no suitable alternative has been developed. The principal problem associated with the prior art pit type quench systems is the mechanical means necessary to recover the parts from the quench pit. While it might at first impression seem to be fairly simple to provide a conveyor means such as a mesh belt at the bottom of a quench pit onto which the work pieces would drop after passing through the quench liquid, the environment within which such a conveyor belt must function causes considerable difficulties. Custom design of the pit type quench system to the particular heat treating operation can somewhat reduce the problems that will be experienced; however, such a solution is not available to the job shop type heat treater. Unless enough pieces of a particular type are heat treated to maintain a furnace and pit quench in operation full time, it is often necessary to vary heat treating cycles, the size of the pieces being treated, and the quench medium. Obviously, any such changes which must be made during the operation of a pit type quench present serious and at times expensive problems. The conveying mechanism, usually a mesh conveyor belt, may not function as efficiently at a higher speed which may be necessary to accommodate a short heat treat cycle. A mesh size that works well for one size part may allow a smaller part to drop through the belt. Pit quenches requires a considerable volume of quenchant and it involves a considerable expense to change the type of quenchant.

Very often work dropping through the quench liquid in a pit quench does not stay on the conveyor belt. When such parts fall off the belt they can jam the belt or otherwise damage it so as to require maintenance. In order to repair or free such a belt it is necessary to either evacuate the quench liquid from the pit or withdraw the mechanism, neither of which alternatives lend themselves to rapid repair of the down equipment. Maintenance of both the parts handling mechanism and the quenchant itself is made more difficult by the buildup in the it of scale from the quenched parts.

Splashing of the quenchant is another problem resulting from the work dropping into the quench liquid. The heat transfer from the pieces to the quench liquid can produce boiling at the surface which increases the splashing. Aside from its deleterious effect upon the quality of the quench and the possible damage to the furnace that it can cause, splashing results in a loss of the quenchant. At times, the loss can be quite significant and, coupled with loss of the quenchant resulting from dragout, may require constant and expensive addition of fresh quench liquid.

In addition to problems directly related to the quenching apparatus and the quenchant, the pit type quench systems can also be troublesome from the standpoint of providing a thorough quench of each and every piece of work. As the work is dropped from, say, a shuffle hearth, the pieces can, depending on their particular size or shape, group or lump together into a rather solid mass. Obviously, a relatively solid mass will not have the surface area of each piece comprising that mass properly exposed to the quenching liquid. Hence, the desired metallurgical properties will not be obtained. Even if massing of the work pieces does not occur, unless the quench liquid itself is properly circulated certain zones could become overheated, decreasing the temperature difference between the work and the quench liquid and, hence, decreasing the quality of the quench.

Although there is no teaching in the prior art of a quench system which would solve the problems discussed above, British patent No. 939,453 does disclose, rather schematically, a quench system wherein the quenchant is used to convey the parts as they are being quenched. While the invention herein disclosed also utilizes the quenchant to both quench and convey the parts, there are significant differences in the structure of this system, particularly at the inlet and the discharge, which result in a practical, commercially operable quench system not taught or suggested by the British patent.

SUMMARY OF THE INVENTION

The present invention involves a liquid quenching system for small parts wherein the parts are conveyed by the quenchant from the discharge end of the furnace in which the parts are heat treated to a segregating device which separates the quenched parts from the quenchant and transfers the parts to a suitable receptacle or further conveying means. Heat treated parts discharged from a continuous furnace such as a conveyor belt, a shaker hearth or a shuffle hearth type furnace drop into a funnel at the inlet end of a quench chute containing a quench liquid. As the parts drop through the quench chute, they are simultaneously quenched and conveyed by the quench liquid, additional high-velocity quench liquid being pumped into the chute to carry the parts along. After an initial downward portion, the chute has an upward-inclined portion that is in fluid communication with a reservoir for the quenchant. Both the parts and the conveying quench liquid are discharged into segregating means which permit the quench liquid to be returned, by means of the reservoir and pump, to the quench chute. Less quenchant is required for this closed system than for the pit type quench. The segregating means also transfers the complete heat treated and quenched parts directly into suitable receptacles.

In the preferred embodiment the higher velocity quenchant is introduced into an annular space in the chute, immediately downstream from the inlet opening, the annular space being formed by the inner wall of the quench chute and the outer wall of the funnel which extends into the quench chute.

The segregating means is disposed partially within the quenchant reservoir and comprises a rotatably mounted drum having an internal auger flight. The parts and quenchant are discharged below the liquid level in the reservoir to reduce noise, splashing and aeration of the quenchant. The rotation of the drum serves to reduce the turbulence attendant to the discharge of the combined quenchant and the work as well as to move the work out of the reservoir and "tumble dry" it before discharging it into suitable receptacles.

In an alternative embodiment the additional quenchant is pumped into the quench chute at approximately the end of the downward portion of the chute prior to the chute beginning its upward incline.

Accordingly, it is an object of the present invention to provide a liquid quenching system for small parts wherein the quenchant serves to convey the parts as well as to quench them.

It is a further object of the present invention to provide a liquid quench system which does not require a pit installed quench tank and attendant mechanical handling equipment submerged in said quench tank.

It is yet another object of the present invention to provide segregating means for combined quenchant and work pieces which permits the return of the quenchant to a reservoir and transfers substantially dry, heat treated and quenched parts to a suitable receptacle.

Further objects and advantages of the present invention will become apparent as the following description proceeds, and the features of novelty which characterize the invention will be particularly pointed out in the claims annexed to and forming a part of the specification.

BRIEF DESCRIPTION OF THE DRAWINGS

For a better understanding of the present invention, reference may be had to the accompanying drawings in which:

FIG. 1 is a perspective view;

FIG. 3 is an elevational view from the reservoir end of the quenching system;

FIG. 4 is a top plan view of the quenching system;

DESCRIPTION OF THE PREFERRED EMBODIMENTS

Figure 2:
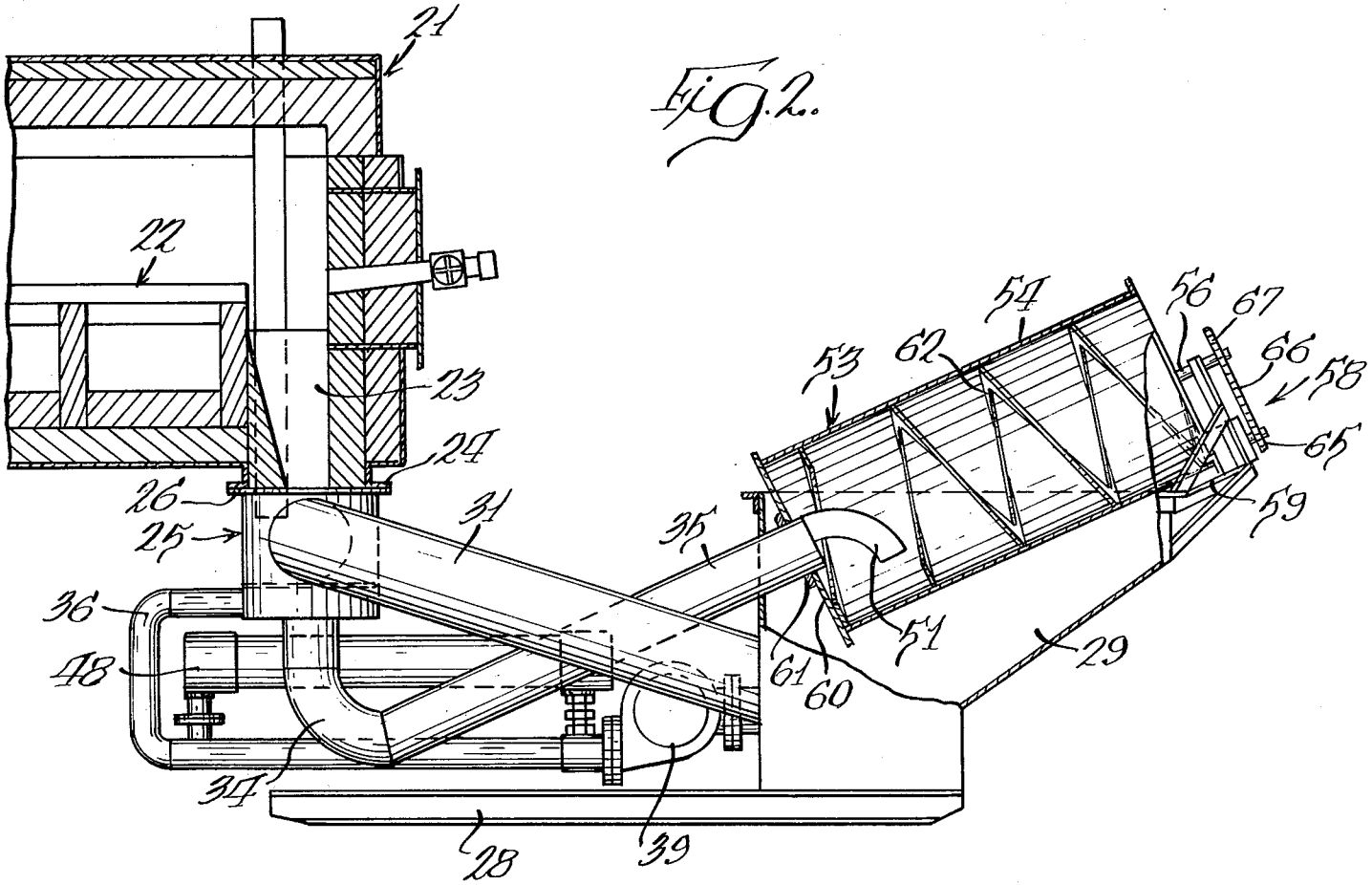
FIG. 2 is a side elevational view, partially in section, showing a fragment of a furnace in section, the portion of the liquid quenching system shown in section being taken substantially along the line 3—3 of FIG. 1.

Referring to the drawings in which like parts are designated by like reference numerals in the various views, there is shown in FIG. 1 a liquid quenching system generally designated by reference numeral 20. As shown in FIG. 2, the liquid quenching system of the present invention is intended to be used with a continuous furnace such as the shuffle hearth furnace 21 which is merely representative of one of several different types of furnaces which may be used with the instant invention. The furnace 21 forms no part of the invention and is merely included in FIG. 2 to better illustrate the relationship between the quench system and a furnace. Any one of a number of different types of furnace generally used for the processing of small parts such as shuffle hearth furnaces, shaker hearth furnaces, or conveyor belt furnaces would work well with the quench system of the present invention. In any of these types of furnaces the work to be heat treated, generally comprising small parts such as screws, nuts, washers, bolts or pins which can range in size anywhere from a fraction of an ounce to a number of pounds, are moved through the furnace as they are being heated along a hearth similar to that designated by reference numeral 22. When these parts reach the end of the hearth 22 they are automatically discharged by gravity through a discharge channel 23 or the like. At the bottom of the furnace discharge channel a flange 24 is provided.

A quench connector 25 is secured to the bottom of the furnace immediately below the discharge channel 23. This can be accomplished by a nut and bolt assembly of the flange 26 on the quench connector to the furnace flange 24. Although not shown in the drawings, asbestos rope or the like may be placed between the flanges to maintain a gas-tight seal in the event that the heat treating is being done under a controlled atmosphere. As will be more fully explained later in this specification, the quench system of the instant invention is well suited to maintaining a seal against either loss or contamination of the controlled atmosphere during the quenching process.

The entire liquid quench system can be supported on a platform or skid such as that designated by reference numeral 28 making it an integral, self-contained unit which can be easily connected to any existing furnace installation merely by making the above-described attachment of the quench connector 25 to the furnace. It will, of course, be necessary to make suitable power connections as well as to connect various pipe lines for supplying quench liquids. However, it is not necessary to excavate any pits for the quench system which, as will be appreciated by those involved in the erection and maintenance of heat treating facilities, can prove an expensive, time-consuming and burdensome task.

Contained on the platform 28 is the reservoir or tank 29 which will contain the greater portion of the quench fluid present in the system at any time. Interconnecting the reservoir 29 and the quench connector 25 is a supply conduit 31 which angles upwardly from the tank 29 to the quench connector 25. On the principle that under normal pressure liquid will seek its own level in any interconnected columns, the conduit 31 is used to maintain a quench liquid level in the quench chute somewhat below the top of the connector 25. It will be noted from FIGS. 2 and 6 that the conduits 31 and 131 shown respectively therein are each at an angle although not the same angle. By maintaining the conduit 31 or 131 at an angle of approximately fifteen to twenty degrees the quench liquid itself is used to provide an effective seal against the loss or contamination of any controlled atmosphere that may be used in the furnace 21. Although not shown in the drawings, a seal may also be provided in a horizontal conduit by means of a vertical depending wall within the conduit. Such a wall would extend below the normal operating level of the quenchant and form a liquid seal against the passage of any gas through the conduit in the same manner as the angled conduits 31 and 131. The angled supply conduit or a horizontal conduit with a depending vertical wall will serve to maintain a liquid seal in the conduit in spite of any changes in the level of the quench liquid that might occur during normal operation of the quench system.

Thus, it will be appreciated that quench connector 25, by virtue of the communication with the quench tank 29 through conduit 31, will contain an initial volume of quenchant into which the parts or heat treated work from the furnace 21 will drop. As the parts drop into the quench chute connector 25, they are directed by means of a funnel or cone-shaped member 33 into the quench chute proper 34. It is desirable to maintain the quenchant level at approximately two inches above the top of the cone 33. If the level is too low air may be drawn into the quench chute and if the level is too high, there will not be any turbulence on the surface of the quenchant to minimize splashing.

Also connected to the reservoir 29 is a quench liquid feed conduit 36. A pump 39 is included in the feed conduit 36 for pumping quench liquid from the reservoir to the quench chute. The details of the pump form no part of the instant invention, and any suitable liquid pump such as the centrifugal type pump 39 or a vertical in-line pump 139 in the alternative embodiment may be used. While the capacity of the pump can vary from installation to installation, it has been found that a 400 to 450 gallon per minute pump cooperates well with a 300 pound per hour shuffle hearth furnace.

Figure 5:
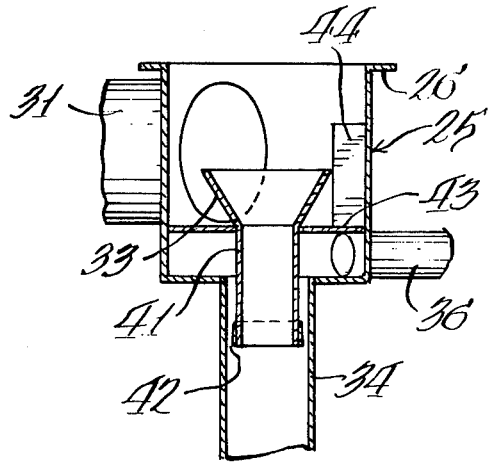
FIG. 5 is an enlarged fragmentary sectional view taken substantially along the line 5—5 of FIG. 4.

The quantity of quench liquid pumped through the feed conduit 36 enters the quench connector 25 outside of and below the top of the funnel 33. The funnel 33 is, as best shown in FIGS. 4 and 5, centered within both the quench connector 25 and the quench chute 34. The funnel 33 ends in a straight cylindrical portion 41 extending into the quench chute; portion 41 is of a smaller diameter and centered within the quench chute 34 thereby forming an annular space 42. Above the annular space and below the top of the cone 33 is a horizontal wall 43 that prevents the pumped-in quench liquid from going up into the furnace. The annular space 42 is of considerably less area than the cross-sectional area of the feed conduit 36, the portion 41 of the funnel or the quench chute 34. As the quench liquid is pumped into the quench connector 25 by virtue of the feed conduit 36 and forced through the annular space 42 there is a further increase in the velocity of the added quench fluid. This higher velocity added quenchant carries the heat-treated parts down through the quench chute and up the inclined portion 35 of the quench chute. The specific pressures and velocities involved, of course, vary from application to application depending upon the size and weight of the work being treated, the viscosity of the quenchant, the size of the conduits and quench chute, and of course the distance and more particularly the height through which the work must be conveyed in the inclined portion of the quench chute. Particularly recognizing the variations which can occur taking into account all of the above-mentioned parameters, no specific determination has been made of the maximum angle of incline for the portion 35 of the chute. However, it has been found that the system functions very well when the upwardly-inclined portion 35 is at an angle of approximately 25° to the horizontal.

Baffle members such as vertical baffles 44 are positioned inside the quench connector above the horizontal wall 43 to minimize swirl and eliminate traces of whirlpools that might result from aspiration of the quenchant and work through the funnel 33 by the added quenchant pumped through the annular space 42. The initial contact between the work and the quenchant is the most important from the standpoint of obtaining a good quench. As the parts drop into the quench liquid in the connector 25 the turbulence of the quenchant tends to prevent or break down the formation of any vapor barrier around the parts. Dropping of the parts into the turbulent quenchant also prevents any massing or grouping of individual parts. Additionally, the aspiration of the quenchant draws out of the zone of initial contact any quench liquid which has become heated by the parts coming from the furnace thus maintaining unheated quench liquid at the initial interface between the parts and the quenchant. This aspiration also minimizes the generation of fumes particularly when oil is used as a quench liquid, such fumes being harmful to the furnace atmosphere if permitted to go back into the furnace. Swirls or whirlpools, however, would inspirate air into the quenchant at a point where the work first enters and interfere with the efficacy of the quench. As the parts are conveyed through the quench chute they are thoroughly agitated in the conveying quench liquid to insure a proper quenching of the entire surface area of each part.

Particularly when certain types of oil are used as quenchants there is a tendency for the quenchant to become heated to a degree that the normal circulation of the quenchant does not sufficiently remove the heat imparted by the work pieces being quenched. Although the circulation and agitation of the quench liquid obtained with the present invention does provide a greater degree of cooling of the quench liquid than was experienced with the prior art pit type quenches, a heat exchanger of suitable design could be included at various points in the quench system of the present invention. It has been found convenient to include a bypass type heat exchanger such as that designated by the reference numeral 48 in parallel with the feed conduit 36. The heat exchanger 48 can be of any suitable design, the details of which form no part of the instant invention. While not shown in the drawings, suitable valve means can be included to permit control of the amount of quenchant bypassed through the heat exchanger.

Figure 6:
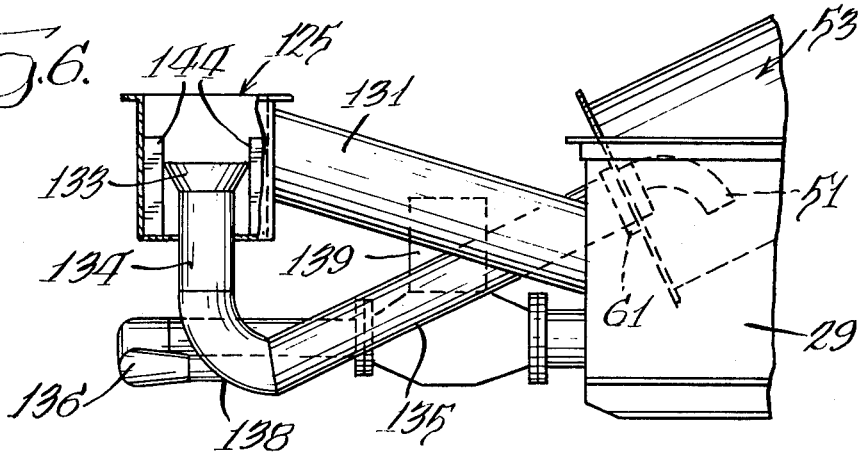
FIG. 6 is a fragmentary side elevational view of an alternative embodiment from that shown in FIGS. 1 through 5.

The outlet end of the quench chute 34 extends into the tank 29. In the embodiment shown in the drawings the quench chute passes through the wall of the reservoir although it of course could merely be extended over the top of the reservoir. However, in order to maintain as compact a system as possible and not require the quench conveying system to carry the heat treated parts over any greater height than is necessary, it is preferred to have the inclined portion of the quench chute 35 go through the wall of the reservoir 29 as best shown in FIGS. 2 and 6.

At the discharge end of the quench chute there is provided a deflector member 51. The particular design details of the deflector member 51 are not extremely important other than it be of such a design as to deflect the combination of the quench liquid and parts emerging from the chute downwardly while reducing the transverse component of their velocity. In order to permit the quench liquid to return to the quench reservoir or at least a very high percentage of the liquid, since there is always an amount of quenchant that adheres to the work and is dragged out with the "dry"

work, there is provided segregating or separating means generally designated by reference numeral 53. It has been found desirable to prevent splashing of the quenchant and to reduce the noise of the parts banging against the deflector 51 to have the combination of the quench liquid and work discharged from the quench chute under the normal level of the quench liquid. However, a more important aspect of discharging the quench chute effluent below the level of the quenchant is that it prevents aeration of the quenchant particularly when oil is utilized as the quench liquid; aeration can be deleterious to the quality of the quench. While the work could of course be discharged into an apertured container or a screen disposed within the tank 29 to collect the parts for eventual retrieval from the tank by a separate operation, such an arrangement would not be in keeping with a continuous automatic operation such as is envisioned by the use of a shuffle hearth, shaker hearth or a conveyor belt type furnace. Similarly, while a mesh conveyor belt or apertured skip bucket type arrangement could be used, such arrangements would merely result in a partial solution to the types of mechanical handling problems which were experienced with the prior art pit type quench systems in that parts would still be lost into the quench reservoir and parts could jam or otherwise require repair of the conveyor system.

The segregating means 53 of the instant invention comprises a substantially closed structure formed of foraminous material which prevents the loss of any parts and permits the throughflow of the quench liquid which is at least partly within the quench tank and supported for rotation at an angle to the horizontal. A drum 54 for receiving the deflected parts and quench liquid is mounted for rotation at the receiving end about the inclined portion 35 of the quench chute which serves as a trunnion and has a shaft 56 at the discharge end that is suppoted for rotation on the reservoir. The receiving end of the drum is in the tank 29 below the level of the quenchant and lower than the discharge end of the drum which extends slightly beyond the reservoir. It is convenient to support the shaft 56 along with the various drive components generally designated by reference numeral 58 on a shelf 59 mounted on the quench tank 29. The lower end of the drum 54 has an end wall member 60 with a central aperture around which is formed a collar 61 that functions as a bearing surface for the rotation of the drum 54 about the inclined portion 35 of the quench chute. When mounted on the quench chute the lower or receiving end wall 60 of the drum is closed thereby preventing any parts from dropping into the reservoir 29. Contained within the drum 54 is an auger flight 62 which acts as a screw conveyor for the quenched pieces transferring them out of the quench tank and depositing them into a suitable receptacle adjacent to the quench system or, alternatively, the pieces could be discharged from the segregating means 53 into another continuous conveying means to transport the complete heat treated and quenched parts to another location for further processing, storage or shipment. A portion of the auger flight 62 has been omitted from the showing in FIG. 2 to better show the deflector 51. The inclined auger flight reduces dragout of the quenchant in that the parts are in effect "tumble dried" as they are moved up the rotating drum 54.

Under certain conditions it is possible that parts may be conveyed through the quench chute at a rate that is too fast to allow completion of the quench. The initial contact between the parts and the quench will have been sufficient to completely expose all of the surface area of the parts as they are conveyed and agitated through the chute to thoroughly and effectively quench the surface. However, for some of the larger parts, further time within the quench may be required. Hence, in the instant invention, as the parts emerge from the outlet end of the quench chute 34 they are maintained in the quenchant contained in the lower, submerged receiving end of the drum 54. Therefore, the parts are subjected to an additional quench period before they are transferred out by means of the auger flight 62 mounted in the rotating drum 54.

The inclined, rotating, foraminous, circumferential wall of the separating means 53 also acts as a filter to remove any scale from the quenchant that may fall off the parts as they are passing through the quench chute.

The drive mechanism for the drumm 54 may comprise any suitable power source and transmission. For example, as shown in FIGS. 1 through 4 the drive mechanism 59 comprises a motor 64 having a sprocket 65 which, through the chain 66, drives the gear 67 keyed to the axle 56.

Figure 7:
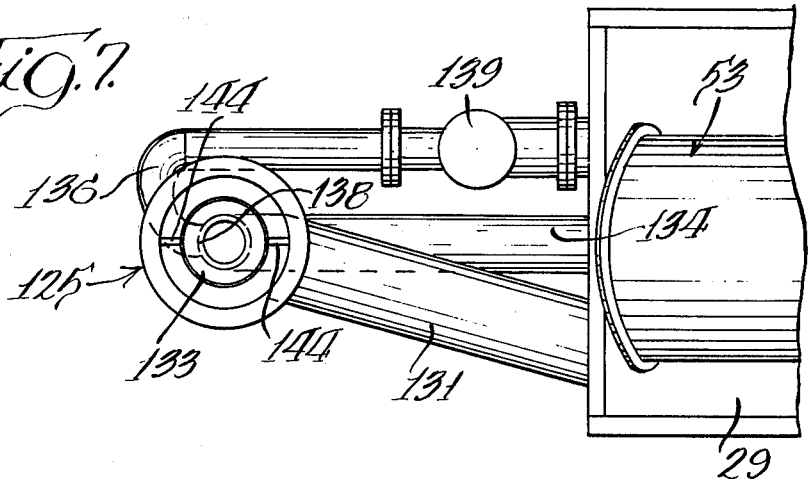
FIG. 7 is a fragmentary top plan view of the alternative embodiment.

The alternative embodiment shown in FIGS. 6 and 7 differs from the embodiment previously discussed primarily in the manner in which the added quench liquid is pumped into the quench circuit. There are of course some other minor differences such as the previously-mentioned difference in he angle of the supply conduit that is designated as 131 in the alternative embodiment and the different type of pump which is designated as 139 in the alternative embodiment. In the alternative embodiment the feed conduit 136, rather than being connected to the quench connector 125, is connected directly to the quench chute 134 at 138, approximately where the chute changes direction from a downward, substantially vertical chute to the upwardly-inclined horizontal portion 135. A flared portion of the inlet end of the quench chute itself forms the funnel 133. Baffle members 144 are provided in the quench connector 125 to minimize any swirls or whirlpools. The feed conduit 136 at the point of connection 138 is substantially horizontal and, hence, the higher velocity quench liquid is introduced into the quench chute 134 horizontally. This horizontally injected, higher velocity quench liquid picks up the parts after they have dropped by gravity through the vertical portion and conveys them upwardly and out of the inclined portion 135. The combined quenchant and work emerging from the inclined portion of the quench quite strikes a deflector 51 similar to that described in the preferred embodiment and then drops into segregating means 53 as discussed above.

While specific embodiments of the present invention have been shown and described, it will be apparent to those skilled in the art that various changes and modifications may be made without departing from the invention in its broader aspects, and it is, therefore, contemplated in the appended claims to cover all such changes and modifications as fall within the true spirit and scope of the present invention.

What is claimed as new and desired to be secured by Letters Patent of the United States is:

1. A quenching apparatus for a heat treating furnace comprising a reservoir containing a liquid quenchant, a quench chute having an inlet end positioned to receive heated parts discharged from the furnace, a quench connector provided between the furnace and said quench said chute, a funnel member disposed in said connector, the lower portion of said funnel member extending into said quench chute, said quench chute having an initial downward portion and an upward-inclined portion terminating in an outlet end, said outlet end being in fluid communication with said reservoir, means supplying said quenchant from said reservoir to said quench chute, said means comprising a first conduit and a second conduit, said first conduit supplying quenchant by gravity flow and said second conduit including pump means for pumping additional quenchant into said quench chute, both said first and second conduits supply said quenchant to said chute above said inlet end, said second conduit pumping quenchant into said chute through said connector below the top of said funnel member, said parts received from he furnace being quenched in said chute and conveyed through said chute by the quenchant, segregating means provided at said outlet end for receiving both said parts and said quenchant, said segregating means permitting return of said quenchant to said reservoir and providing continuous discharge of said parts substantially dry of said liquid quenchant.

2. A quench apparatus as defined in claim 1 wherein said first conduit supplies said quenchant to said connector above said inlet end and above said second conduit.

3. A quench apparatus as described in claim 2 wherein a wall member is provided in said connector above second conduit and below the top of said funnel member.

4. A quench apparatus as defined in claim 2 wherein a baffle member is provided in said connector to reduce swirling of the quenchant in said connector.

5. A quenching apparatus for a heat treating furnace comprising a reservoir containing a liquid quenchant, a quench chute having an inlet end positioned to receive heated parts discharged from the furnace, a quench connector between said furnace and said quench chute, funnel means disposed in said connector above said inlet end to receive said parts, said quench said chute having an initial downward portion and an upward-inclined portion terminating in an outlet end, said outlet end being in fluid communication with said reservoir, means supplying said quenchant from said reservoir to said connector for flow to said quench chute, said means comprising a first conduit and a second conduit, said first conduit supplying quenchant by gravity flow and said second conduit including pump means for pumping additional quenchant into said connector for flow to said quench chute, said first conduit supplying said quenchant to said chute through said connector above said inlet end, a baffle member in said connector outside of said funnel means to reduce swirling of the quenchant in said connector entering said funnel means with said parts, said baffle member being in the path of flow of equivalent from said connector into said funnel, said second conduit pumping said quenchant into said quench chute downstream if said inlet end, said second conduit for pumping said quenchant into said quench chute being connected to said quench chute at the end of said downward portion downstream from said inlet end approximately between said downward portion and said upward-inclined portion, said second conduit being substantially horizontally disposed at the said connection to said quench chute, said parts received from the furnace being quenched in said chute and conveyed through said chute by the equipment, segregating means provided at said outlet end for receiving both said parts and said quenchant, said segregating means permitting return of said quenchant to said reservoir and providing continuous discharge of said parts substantially dry of said liquid quenchant.

6. A quenching apparatus for a heat treating furnace comprising a reservoir containing a liquid quenchant, a quench chute having an inlet end positioned to receive heated parts discharged from the furnace, said quench chute having an initial downward portion and an upward-inclined portion terminating in an outlet end, said outlet end being in fluid communication with said reservoir, means supplying said quenchant from said reservoir to said quench chute, said means comprising a first conduit and a second conduit, said first conduit supplying quenchant by gravity flow and said second conduit including pump means for pumping additional quenchant into said quench chute, the end of said first conduit connected to said quench chute being at a level higher than the other end of said first conduit which is connected to the reservoir, said parts received from the furnace being quenched in said chute and conveyed through said chute by the quenchant, segregating means provided at said outlet end for receiving both said parts and said quenchant, said segregating means permitting return of said quenchant to said reservoir and providing continuous discharge of said parts substantially dry of said liquid quenchant.

7. A quenching apparatus for a heat treating furnace comprising a reservoir containing a liquid quenchant, a quench chute having an inlet end positioned to receive heated parts discharged from the furnace, a connector between said furnace and said quench chute, funnel means disposed in said connector above said inlet end to receive said parts, said quench chute having an initial downward portion and an upward-inclined portion terminating in an outlet end, said outlet end being positioned below the level of said liquid quenchant in said reservoir, first and second conduit means for supplying said quenchant from said reservoir to said connector for flow to said quench chute, said first conduit supplying quenchant by gravity flow through said connector and said second conduit including pump means for pumping additional quenchant into said connector for flow to said quench chute, a baffle member in said connector outside of said funnel means to reduce swirling of the quenchant in said connector entering said funnel means with said parts, said baffle member being in the path of flow of quenchant from said connector into said funnel, said parts received from he furnace being quenched in said chute and conveyed through said chute by the quenchant, segregating means provided at said outlet end for receiving both said parts and said quenchant, said segregating means permitting return of said quenchant to said reservoir and providing continuous discharge of said parts substantially dry of said liquid quenchant.

* * * * *

UNITED STATES PATENT OFFICE

CERTIFICATE OF CORRECTION

Patent No. 4,036,478 Dated July 19, 1977

Inventor(s) Jonathan Smith, Robert C. Larko, Eugene E. Booth

It is certified that error appears in the above-identified patent and that said Letters Patent are hereby corrected as shown below:

Column 1, line 21 - insert "use" between --during-- and --also--

Column 1, line 55 - "requires" should be --require--

Column 1, line 68 - "it" should be --pit--

Column 3, line 49 - "line 3-3" should be --line 2-2--

Column 7, line 38 - "suppoted" should be --supported--

Column 8, line 19 - "drumm" should be --drum--

Column 8, line 30 - "he" should be --the--

Column 8, line 51 - "quite" should be --chute--

Claim 1, Col. 9, line 1 - "said" should be eliminated between --quench-- and --chute--

Claim 1, Col. 9, line 16, "he" should be --the--

Claim 3, Col. 9, lines 29 & 30 - insert "said" between --above-- and --second--

Claim 5, Col. 9, line 41 - delete "said" between --quench-- and --chute--

Claim 5, Col. 9, line 57 "equivalent" should be --quenchant--

UNITED STATES PATENT OFFICE
CERTIFICATE OF CORRECTION

Patent No. 4,036,478 Dated July 19, 1977

Inventor(s) Jonathan Smith, Robert C. Larko, Eugene E. Booth

It is certified that error appears in the above-identified patent and that said Letters Patent are hereby corrected as shown below:

Claim 5, Col. 9, line 59 - "if" should be --of--

Claim 5, Col. 10, line 5 - "equivalent" should be --quenchant--

Claim 7, Col. 10, line 55 - "he" should be --the--

Signed and Sealed this

*Tenth* Day of *July 1979*

[SEAL]

*Attest:*

*Attesting Officer*

LUTRELLE F. PARKER

*Acting Commissioner of Patents and Trademarks*